US007627967B1

(12) United States Patent
Torvik

(10) Patent No.: US 7,627,967 B1
(45) Date of Patent: Dec. 8, 2009

(54) GREETING CARD AND DISPLAY BOX

(76) Inventor: Brian Peter Torvik, 12029 Stevens Dr., Benbrook, TX (US) 76126

( * ) Notice: Subject to any disclaimer, the term of this patent is extended or adjusted under 35 U.S.C. 154(b) by 4 days.

(21) Appl. No.: 11/856,027

(22) Filed: Sep. 15, 2007

Related U.S. Application Data

(60) Provisional application No. 60/825,719, filed on Sep. 15, 2006.

(51) Int. Cl.
*G09F 1/00* (2006.01)

(52) U.S. Cl. ..... 40/124.16; 40/124.06; 40/748; 40/750; 40/789; 206/45.25; 206/460; 206/486; 206/789; 206/775

(58) Field of Classification Search ..... 40/124.06, 40/124.16, 124.17, 789, 748, 124.19; 206/776, 206/777, 751, 45.28, 772, 45.23; 220/495.05, 220/528; 229/92.8
See application file for complete search history.

(56) References Cited

U.S. PATENT DOCUMENTS

| | | | | | |
|---|---|---|---|---|---|
| 1,347,269 | A | * | 7/1920 | Greble | 40/750 |
| 1,565,758 | A | | 12/1925 | Snider | |
| 1,879,029 | A | * | 9/1932 | Baumgard | 206/45.21 |
| 1,939,824 | A | * | 12/1933 | Mix et al. | 206/45.23 |
| 2,080,997 | A | | 5/1937 | Beckleman | |
| 2,456,064 | A | | 12/1948 | Johnson | |
| 2,593,333 | A | * | 4/1952 | Myers | 206/45.27 |
| 2,748,928 | A | * | 6/1956 | Stavis et al. | 206/560 |
| 3,090,144 | A | | 5/1963 | Malamude | |
| 3,123,207 | A | | 3/1964 | Goldstein | |
| 3,353,658 | A | * | 11/1967 | Ettin | 206/45.25 |
| 4,062,138 | A | * | 12/1977 | Warenback | 40/124.16 |
| 4,129,210 | A | * | 12/1978 | Brown et al. | 206/773 |
| 4,433,780 | A | * | 2/1984 | Ellis | 206/232 |
| 5,822,897 | A | | 10/1998 | Ertzan | |
| 6,145,665 | A | * | 11/2000 | Krahn | 206/756 |
| 6,427,371 | B2 | | 8/2002 | Olson et al. | |
| 2003/0051384 | A1 | | 3/2003 | Miska | |
| 2004/0083631 | A1 | | 5/2004 | Zakova et al. | |

* cited by examiner

*Primary Examiner*—Lesley Morris
*Assistant Examiner*—Kristina Staley
(74) *Attorney, Agent, or Firm*—Guy V. Manning

(57) ABSTRACT

A box assembled from folded sheet material such as paperboard forms a container for a gift object. The container includes a front shroud or cover which opens to reveal the gift object mounted on a background within a framed window. The front cover is attached at the bottom, rear of the container and folds over the top to form a cover of the window. The front cover opens and folds at the rear of the container to form a stand that holds the container upright to display the gift object. The background and perimeter of the window frame may include decorative scenes, slogans, trademarks or other gift card messages or decorations which may be associated with the gift object.

20 Claims, 5 Drawing Sheets

FIG. 1
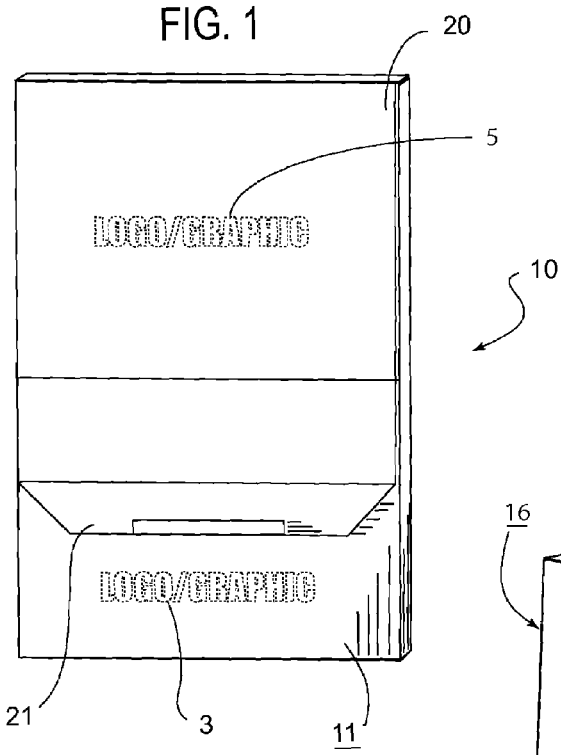
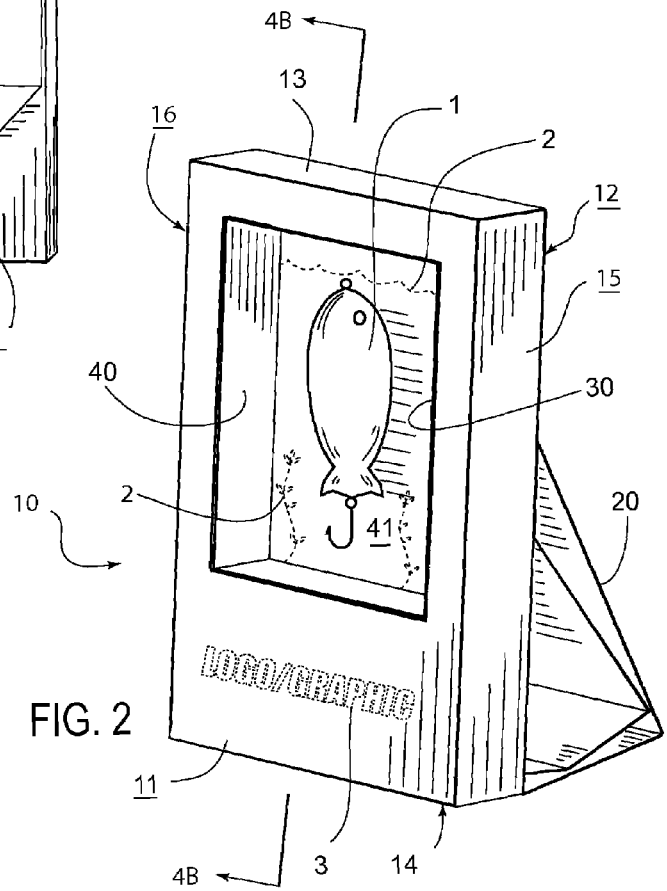
FIG. 2

GREETING CARD AND DISPLAY BOX

BACKGROUND OF THE INVENTION

1. Field of the Invention

This invention relates to greeting cards generally, and particularly to greeting cards which contain and enclose other objects. More particularly, this invention also relates to a greeting card which forms a gift box and display case for objects.

2. Description of Related Art

Greeting cards are ubiquitous, being used for myriad purposes such as seasonal celebrations, personal contact or other messages. Some are simple folded paper with printed messages, while others include clever foldings that create pop-up displays upon one opening the card. Still others contain small objects typically taped or glued to an inside surface such that they are revealed when the card is opened.

Particularly at holiday times, people who receive greeting cards like to display them, usually for decorative purposes, by standing them up and partially opened. Even without the cards containing objects, standing them together commonly results in many of them falling over, collapsing or otherwise defeating the purpose of display. A need exists for means for stabilizing greeting cards whereby they may be displayed efficiently.

When greeting cards contain gift objects, their shape may be distorted by the object, and the object can become damaged in transit. Further, persons receiving gift objects such as medals, symbols of membership or the like often prefer to display those objects and must find means for doing so, usually separately from the gift box in which they arrive. Means for displaying gift objects within their transit packaging creates efficiencies in such displays, reduces waste, and provides senders and others with marketing opportunities.

SUMMARY OF THE INVENTION

Accordingly, it is an object of this invention to provide a greeting card which doubles as a gift box.

It is another object of this invention to provide a greeting card which doubles as a display case for a gift object.

It is yet another object of this invention to provide a gift box which may be used to display a gift object.

It is yet another object of this invention to provide a gift box which includes a built-in stand.

It is yet another object of this invention to provide a gift box which may include aesthetically appealing decorations associated with a gift object it contains.

The foregoing and other objects of this invention are achieved by providing a box assembled from folded sheet material such as paperboard which forms a container for a gift object. The container includes a front shroud or cover which opens to reveal the gift object mounted on a background within a framed window. The front cover is attached at the bottom, rear of the container and folds over the top to form a cover of the window. The front cover opens and folds at the rear of the container to form a stand that holds the container upright to display the gift object. The background and perimeter of the window frame may include decorative scenes, slogans, trademarks or other gift card messages or decorations which may be associated with the gift object.

BRIEF DESCRIPTION OF THE DRAWINGS

The novel features believed characteristic of the present invention are set forth in appended claims. The invention itself, however, as well as a preferred mode of use and further objects and advantages thereof, will best be understood by reference to the following detailed description of an illustrative embodiment when read in conjunction with the accompanying drawings, wherein:

FIG. 1 shows a front elevational view of the gift box of the present invention with its cover closed.

FIG. 2 depicts in left quartering perspective of the gift box of FIG. 1 with its cover folded open to form a support stand and displaying a gift object.

DETAILED DESCRIPTION OF A PREFERRED EMBODIMENT

Figure 3A:
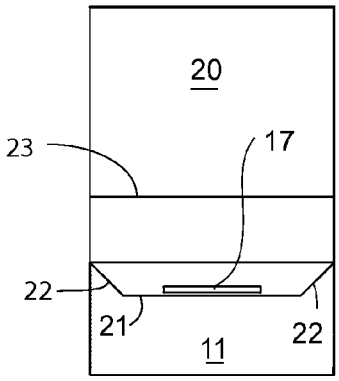
FIGS. 3A-3F demonstrate the manner in which the cover for the gift box of FIG. 1 converts to a support stand as in FIG. 2.
Figure 3B:
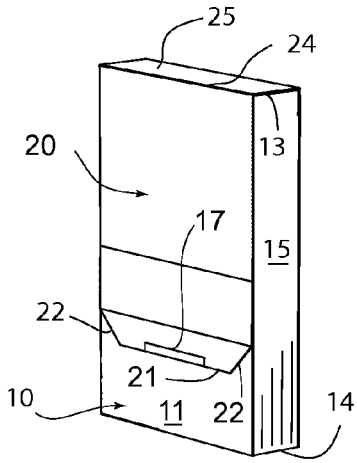

With reference now to the figures, and in particular to FIGS. 1 and 2, the present invention is shown comprising gift box 10 having shroud, or cover 20 terminating in lip 21 and, in its closed position (FIG. 1), covering a substantial portion of front 11. In its open and folded position (FIG. 2), cover 20 converts to a stand by which gift box 10 stands upright or at a tilted angle to display its contents.

Gift box 10 comprises a three-dimensional object defined by left side 15 and opposite, parallel right side 16, top 13 and opposite, parallel bottom 14, thereby defining a substantially rectangular container having front 11 and opposite back 12. Preferably, for the typical purposes of the invention, gift box 10 ranges in size from approximately one inch (1") wide by one and one-half inches (1½") tall and a fraction of an inch deep (between front 11 and back 12) to any size greater. More preferably, gift box 10 is approximately six (6") inches wide by nine (9") inches high and approximately one inch (1") deep. One having ordinary skill in the art will recognize, however, that gift box 10 may comprise any combination of dimensions, shapes and proportions appropriate for its intended purpose, and all such arrangements are considered to be within the spirit and scope of the present invention.

Gift object 1 received within recess, or display window 30 is disposed atop insert 40 (see also FIGS. 4A, 6) which displays screen surface 41, optionally bearing pictorial scene 2 related to gift item 1, such as a fishing lure disposed on a lake scene with a fisherman. Gift object 1 may be held in place against screen 41 by a variety of known means such as elastic straps (not shown) or other ties, or it may be temporarily or permanently attached to screen 41 by glue, tape or other adhesive means. Preferably, gift object 1 attaches to screen 41 with removable, rubberized adhesive commonly know as "glue dots" 44 (see FIG. 4B).

Graphic messages 3, 5 may be displayed on front 11, on screen 41, on cover 20 or any combination thereof. Graphics 3, 5 may comprise slogans or other sayings related to gift object 1, but alternately may be trademarks, advertising or other messages or additional decoration unrelated to gift object 1. One having ordinary skill in the art will recognize that graphics 3, 5, may be interchangeable, repeated in one or all of the positions described above, or may be absent altogether, without departing from the spirit and scope of the present invention. Further, though scene 2 has been shown and described as limited to the area of screen 41, it may cover the entire surface of box 10, or any portion thereof, and remain within the spirit and scope of the present invention.

Referring now also to FIGS. 3A-3F and 5, shroud cover 20 attaches to the bottom edge of back 12 at crease 27 and extends a selected distance to terminate in lip 21. In its closed position (FIGS. 1, 3A-3B), cover 20 folds parallel to crease 27 at creases 24 and 25 to lap over top 13 and to cover the upper portion of front 11, including window 30. Lip 21 inserts under front tab 17 on front face 11 to latch cover 20 in place, as seen in FIG. 1. Lip 21 preferably is beveled at its corners 22, partly for aesthetic appearance and partly to ease insertion of lip 21 into the slot formed by cover tab 17 on front 11.

Transverse creases 23-26 are disposed parallel each other and top 13 and spaced along the length of cover 20 between lip 21 and attachment 27 to permit cover 20 to lie flat against box 10 when it its closed position. Specifically, creases 24, 25 are spaced apart and from attachment fold 27 such that they coincide with and enclose top 13 when cover 20 is closed (FIG. 1). Creases 23-27 further serve to form the stand shown in FIG. 2. Crease 23 is disposed between crease 24 and lip 21 to coincide substantially with crease 26 when cover 20 is folded as in FIGS. 2, 3F. NOTE: hereinafter as proves convenient, a segment of cover 20 between two folds will be referred to as "segment X-Y", where "X" and "Y" refer to two successive folds.

Following now the sequence of FIGS. 3A-3F, box 10 is shown in front elevational view (FIG. 3A) and partially rotated (FIG. 3B) about a vertical axis toward side elevational view (FIG. 3C) with cover 20 remaining in its closed position (as in FIG. 1). Beginning with FIG. 3C, cover 20 is shown in successive steps leading to its folding to form the support stand shown in FIG. 2.

Figure 3C:
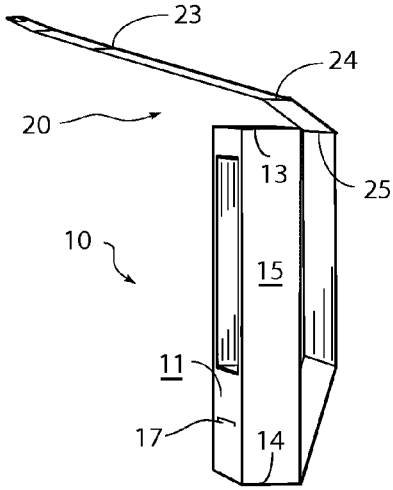
Figure 3D:
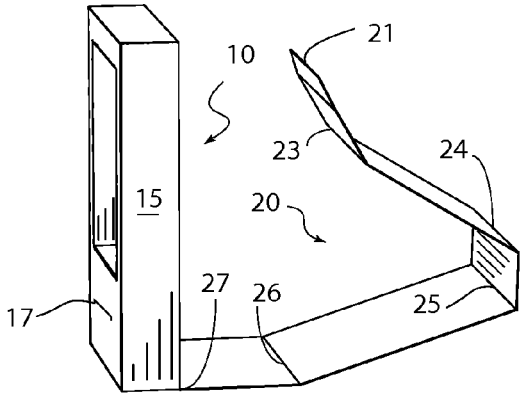
Figure 3E:
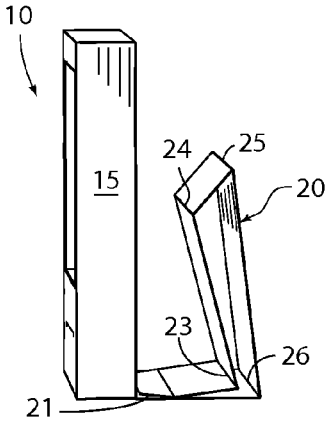

As depicted in FIG. 3C, cover 20 disengages from tab 17 and unfolds from covering top 13 to move to the rear of box 10, thereby flexing at attachment crease 27 to cause segment 27-26 to lie substantially perpendicular to back 12. In FIGS. 3D-3E, fold 25 flexes to bring lip 21 toward attachment fold 27, thereby bringing crease 23 into proximity with crease 26. Finally, in FIG. 3F, crease 25 folds into an acute angle and inserts beneath back tab 18, with segment 24-25 juxtaposed back 12, to hold cover 20 in its folded configuration forming the support stand. Box 10 then may be placed on a horizontal surface (not shown) and resting on its base (segment 26-27).

Figure 3F:
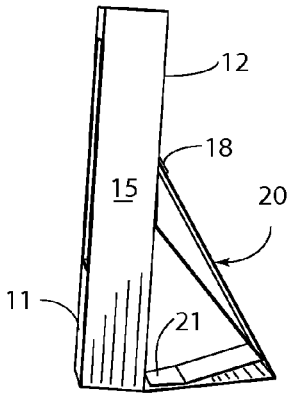

As best seen in FIGS. 2 and 3F, a slight angle persists between back 12 and the base (segment 26-27), giving a slight backwards tilt to box 10 in its display position. This may be desirable so that gift object 1 and scene 2 may be viewed conveniently. As best seen in FIG. 4B, back tab 18 disposed transverse back 12 parallel to top 13 is placed a spaced distance below top 13 such that folded crease 25 mates therewith when cover 20 is folded to form the stand. Preferably, back tab 18 is located on back 12 such that the center of gravity of gift box 10 is disposed directly above the support stand to optimize stability of box 10 while displaying object 1. One having ordinary skill in the art will recognize, however, that the vertical location of back tab 18 may be chosen to control this angle, and a significantly larger angle than shown in the figures may be desired by the designer and marketer of box 10. Alternately, several back tabs 18 could be introduced at different vertical displacements (not shown) from top 13 to give the donee/user (not shown) a selection of tilts for displaying box 10.

Figure 4A:
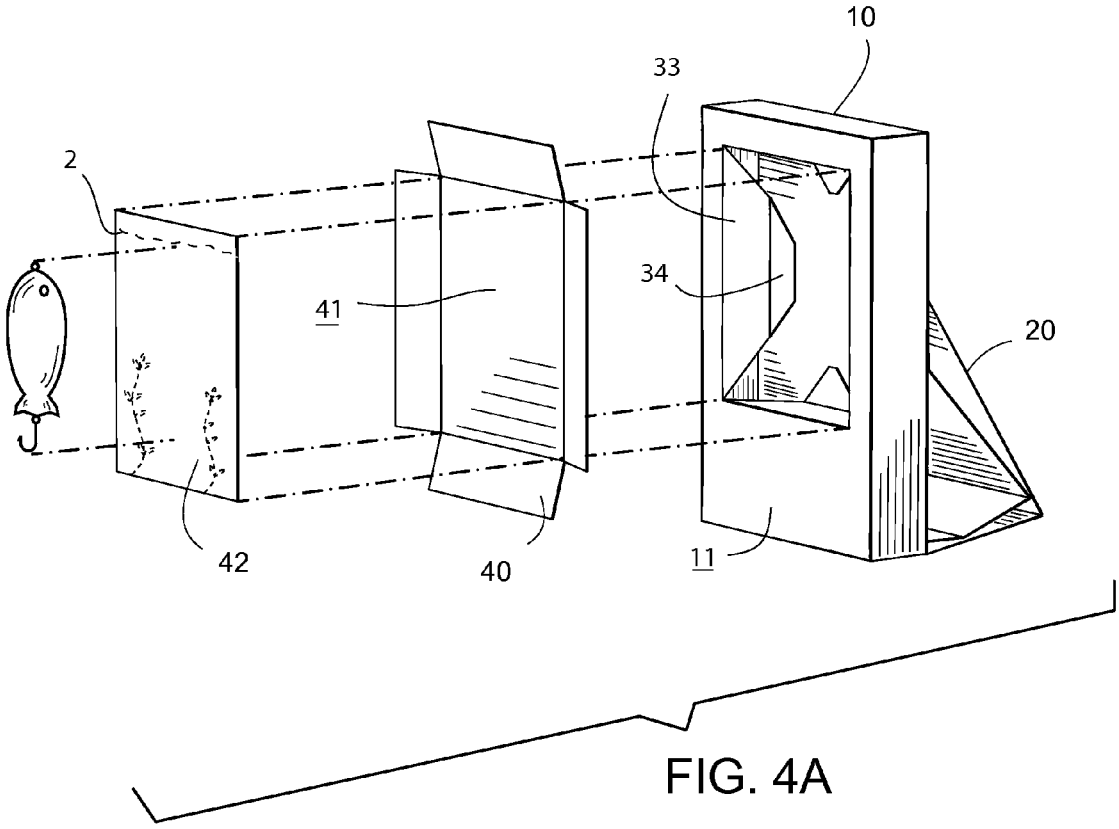
FIG. 4A shows in exploded perspective the components of the gift box of FIG. 1.
Figure 4B:
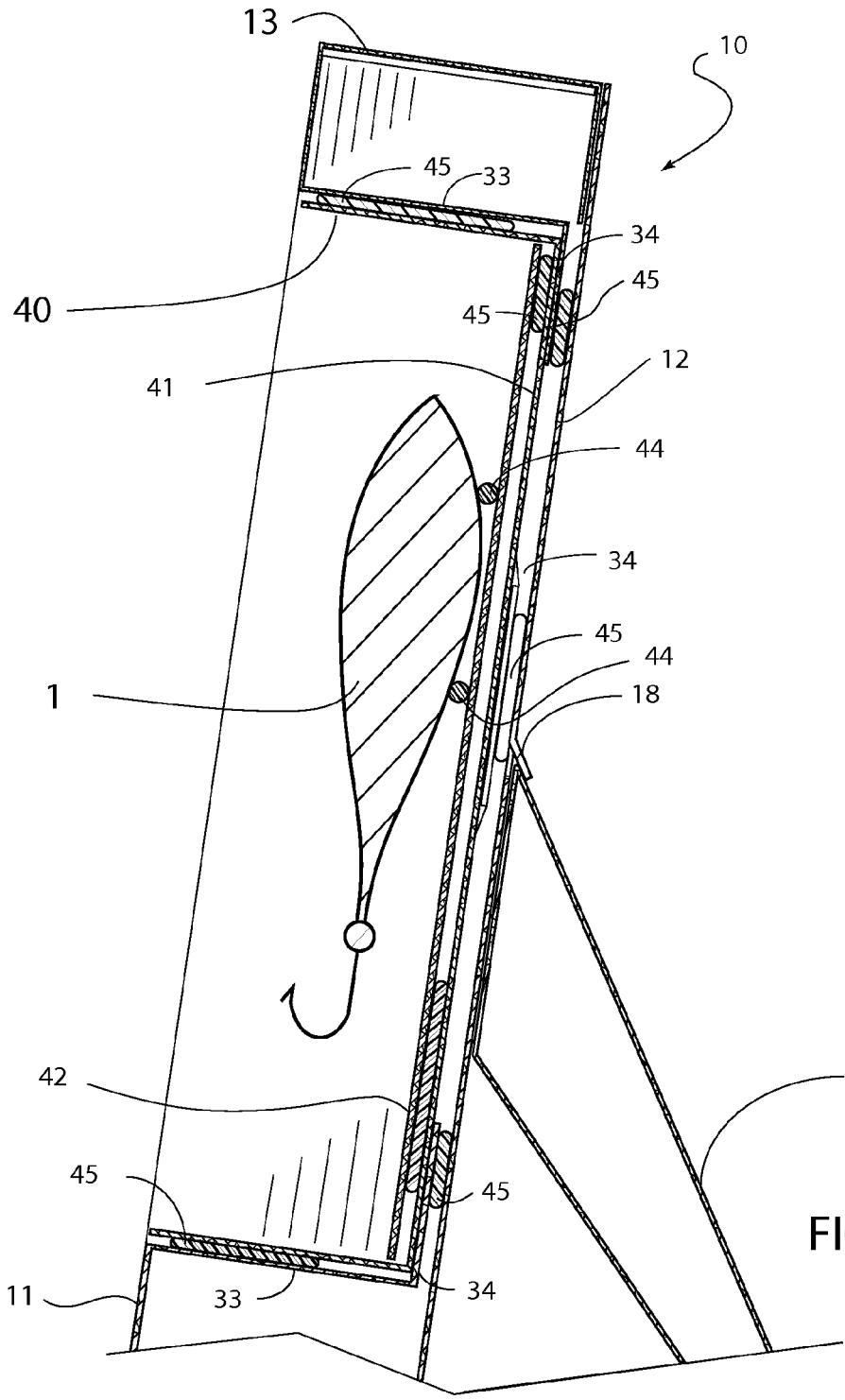
FIG. 4B details in partial cross-section of the gift box of FIG. 1, as indicated in FIG. 2, the components illustrated in FIG. 4A assembled into a finished gift box.

Referring now also to FIGS. 4A, 4B, insert 40 is adapted to be placed within window 30 and to finish it with aesthetic smoothing. Insert 40 comprises screen 41 flanked by wings 43 adapted to be folded perpendicular to screen 41 to form the walls of window 30. So folding insert 40 forms it into a rectangular dish adapted to fit snugly within window 30. By such means, scene 2 may be placed within window 30 after it has been folded to define the recess in which gift object 1 is held. As depicted in FIG. 4A, insert 40 also may include separate card 42 bearing decorative scene 2, or said decorative scene 2 may be imprinted directly onto screen 41, as desired. Card 42 also could be employed to alter another decorative scene imprinted on screen 41 by covering it with card 42.

Figure 5:
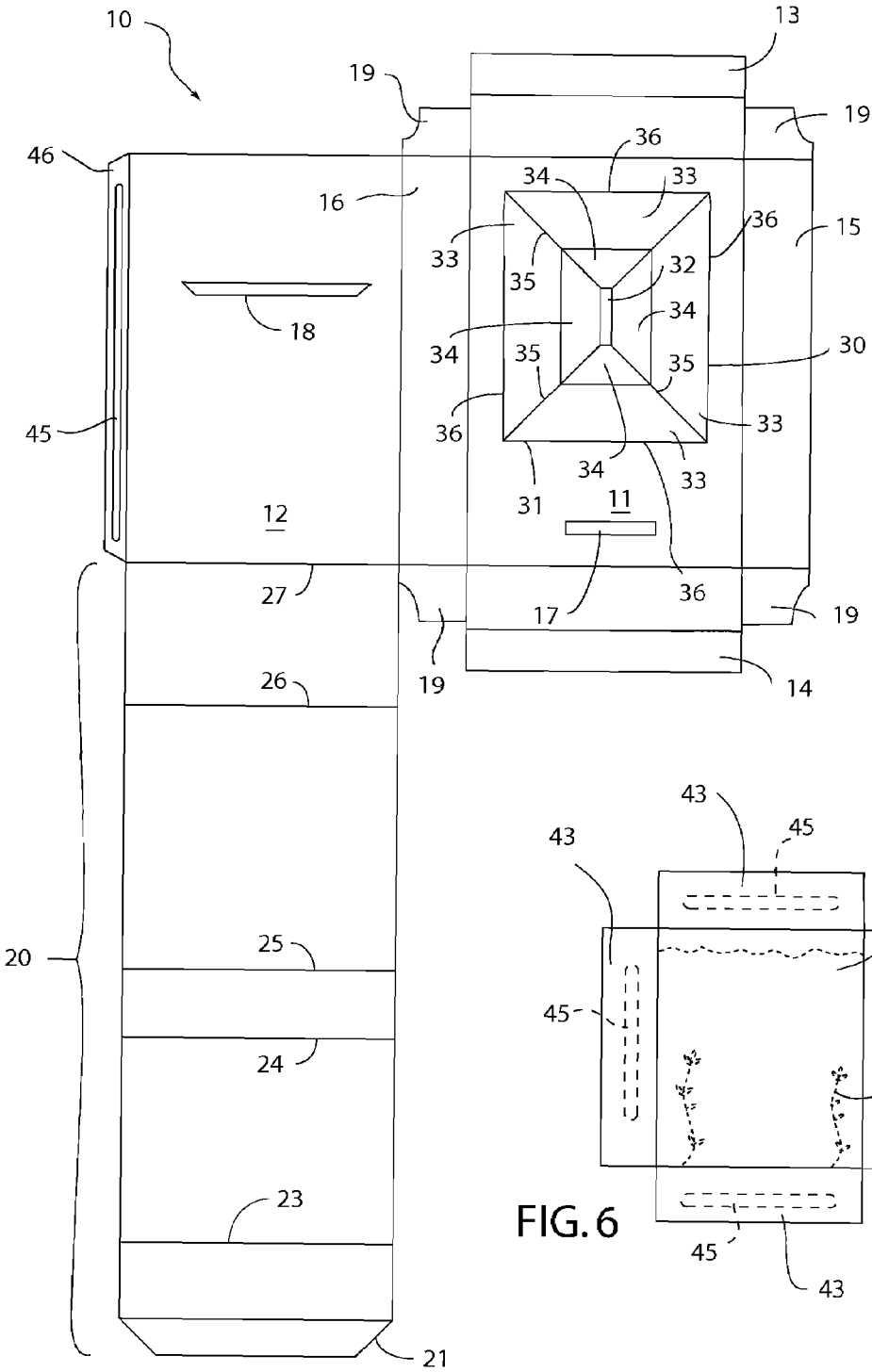
FIG. 5 details the profile and folding requirements for converting a single sheet of flat material into the gift box of FIG. 1.
Figure 6:
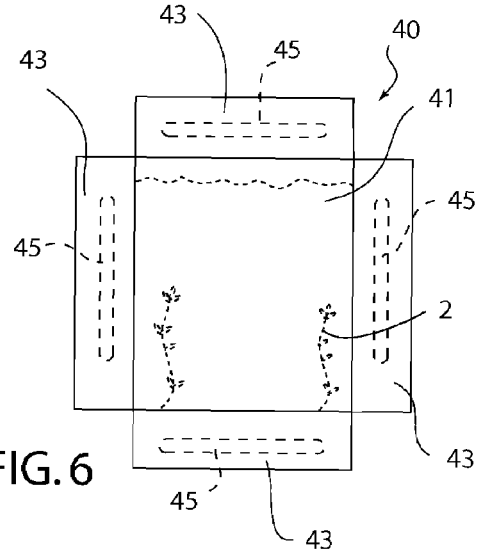
FIG. 6 details the profile and folding requirements for converting a single sheet of flat material into an insert adapted to be placed within a window formed by the folding shown in FIG. 4A.

Referring now also to FIGS. 5 and 6, gift box 10 is fabricated from a single, flat sheet of material, preferably ten to twenty-four (10 pt.-24 pt.) point, gloss finished stock paperboard coated on both sides, but having no polyethylene or other lamination that could impede effective penetration of ink for graphic scene 2 and messages 3, 5 or compromise adhesion of glue strips 45 or glue dots 44. Once imprinted with scene 2 and messages 3, 5, the paperboard preferably is given an aqueous coating further to deter damage to the surface, such as smearing of the ink. The paperboard then is scored in the outline shown in FIG. 5, to create transverse and longitudinal creases at selected locations to form fold points for creating the various components discussed in detail elsewhere herein.

Insert 40 also is fabricated from a single sheet of flat material, preferably the same material as box 10. In fact, as seen from the juxtaposition in the figures of FIGS. 5 and 6, box 10 and insert 40 may be arranged on a single, rectangular sheet of paperboard and cut therefrom with minimal wastage. Further, wherein scene 3 and/or message 5 are desired, they may be printed onto such sheet of paperboard all at once and prior to cutting box 10 and insert 40 therefrom.

Continuing with FIG. 5, front face 11 is flanked on its left and right sides by rectangular tabs forming left side 15 and right side 16, and on its upper and lower sides by tabs forming top 13 and bottom 14. Corner gussets 19 fold with sides 15, 16 and are adapted to couple to top 13, bottom 14 and back 12 to define the three-dimensional box 10. Flap 46 on the left side of back 12 includes adhesive strip 45 for coupling it to left side 15, and gussets 19 preferably fold and tuck within adjacent components of box 10 to hold it together. One having ordinary skill in the art will recognize that other adhesive means (not shown) may be employed to achieve shape stability if desired, without departing from the spirit and scope of the present invention.

Display window 30 disposed within front 11 is formed by creating incision 32 parallel to and equidistant from sides 15, 16, creating incisions 35 extending diagonally therefrom to the four corners of window 30, and folding the resulting triangular pieces normal to front 11 and toward back 12 to form front folds 36, thereby defining the aperture of window 30. A spaced distance toward incision 32 equal to the depth of box 10 and sides 15, 16, rear folds 34 parallel front folds 36 and create tabs adapted to lie disposed against back 12 when box 10 is folded into its three dimensional shape. Tabbed folds 34 may extend inside window 30 or toward sides 15, 16 and top 13 and bottom 14 as preferred. In the latter case, however, tabs 34 define a minimum separation between front folds 36 and sides 15, 16, as it is most desirable that walls 33 of window 30 remain substantially perpendicular to front 11 and back 12. Tabbed folds 34 may be secured to back 12 with adhesive strips, as best seen in FIG. 4B, but preferably the use of insert 40 and its adhesion strips 45 adequately secure tabbed folds 34 as well.

In operation, box 10, with insert 40, may be provided in flat form as depicted in FIGS. 5 and 6, ready to be assembled. The perimeters of box 10 and insert 40 will have been cut completely out of surrounding material, or, alternately, they may remain attached (not shown) thereto by easily disengaged retaining bridges (not shown), as is known in the industry for paper products. Creases 23-27 will have been created as part of the manufacturing process. Graphics 2, 3, 5 may already have been imprinted as desired using stencil, screen printing, lithography printing or other known means, or these may be provided for the user (not shown) in sticker form, painted on by the user or otherwise introduced in the assembly process. Gift item 1 likewise may be provided with box 10 or separately by the user.

In any case, once box 10 and insert 40 are isolated from surrounding material, they may be assembled as discussed above. Specifically, box 10 is folded at its corner lines shown in FIG. 5, and flap 46 invested with side 15 using adhesive strip 45, while gussets 19, top 13 and bottom 14 are tucked in as conventionally done with boxes to create the three dimensional object shown in FIG. 1. Window 30 is created by flexing front folds 33 inward perpendicular to front 11 and back 12, while tabbed folds 34 are laid against back 12, preferably extending toward the middle of window 30. Glue strips 45 may be included to hold tabbed flanges 34 in position (see FIG. 4B). Wings 43 on insert 40 are folded perpendicular to screen 41 and insert 40 is introduced into window 30 and held in place with glue strips 45. Gift object 1, if not already attached to screen 41 (by known means, such as glue dots 44 as shown in FIG. 4B). Next, cover 20 is folded at creases 27, 24 and 25 to cause it to lie flat against back 12, top 13 and front 11, preferably covering window 30, and secured in place by inserting lip 21 beneath front tab 17. Cover 20 and box 10 may be further reinforced in the folded position using plastic tape (not shown) if desired. Box 10 then may be addressed on the back of cover 20 and posted for mailing gift object 1 to a donee (not shown). Alternately, box 10 then may be wrapped in paper or inserted into a mailer box to protect box 10 during transit. Also, box 10 maybe sold as retail gift inventory, assembled or not, without being sent through the mail or other common carrier.

When the donee receives box 10, he may remove lip 21 from slot 17 and open box 10 to reveal gift item 1 and read the messages or view the art work of graphics 2, 3, 5. Then, the donee folds cover 20 backwards away from front 11 (FIG. 3C) by grasping lip 21 and flexing fold 27 (FIG. 3D) until lip 21 may be inserted adjacent back 12 at fold 27 (FIG. 3E). This causes folds 26, 25 and 23 to flex (FIG. 3E) so that fold 25 may be inserted beneath back tab 18, thereby forming the stand (FIG. 3F). The user then places box 10 on a horizontal surface (not shown) resting on segment 27-26, and facing a convenient direction for the desired viewing of object 1. Should the user wish to store box 1 with object 1, he simply reverses the foregoing steps to disengage fold 25 from tab 18 and extends cover 20 to lay against back 12, top 13 and front 1, tucking lip 21 into front slot 17 again to cover window 30 and protect object 1.

The present invention, when used in conjunction with the above procedures, forms gift box 10 which may contain, transport and display gift object 1. When the donee (not shown) opens gift box 10 by lifting cover 20 out of the way, he may continue to fold cover 20 as described above to form a stand for displaying gift object 1.

While the invention has been particularly shown and described with reference to preferred and alternate embodiments, it will be understood by those skilled in the art that various changes in form and detail may be made therein without departing from the spirit and scope of the invention. For example, the transverse width of cover 20 is shown in the figures to be co-extensive with the width of front 11 and back 12, but it could be any width from as wide as or wider than front 11 to as narrow as window 30 and serve its intended purpose. Further, it need not be rectangular, but could comprise other profiles as desired for function and aesthetics. Still further, though cover 20 is shown in the figures as solid and opaque, it could comprise apertures, transparent material or the like which would allow viewing object 1 and graphics 2, 3, 5 without removing cover 20.

Yet further, cover 20 has been described as being secured in place over window 30 by tucking lip 21 under front tab 17, but it also could be secured by using a glue dot 44 beneath lip 21, thereby eliminating tab 17 altogether. The salient feature of these two alternatives is the ability to reclose cover 20 over window 30, and any other known means, such as hook-and-loop fasteners (known by the trade name Velcro®), snaps, buttons or string ties, could be substituted.

Finally, scene 2 has been described herein as being imprinted onto screen 41 or card 42 and inserted into window 30 to be visible through window 30. Alternately, tabs 34 could be folded to extend adjacent back 12 from walls 33 toward, instead of away from (as shown in the figures, particularly FIG. 4A) sides 15, 16, top 13 and bottom 14, thereby permitting scene 2 to be imprinted directly onto back 12 without the use of insert 40 at all.

I claim:

1. A gift box comprising a body having a substantially planar front having a front top edge;

a back substantially coextensive with the front and disposed a spaced distance behind the front, the back having a back top edge and a back bottom edge opposite the back top edge; and at least one side wall coupled between the front and back to define an interior;

a window disposed within the body and having screen means disposed within and lining the window; and attachment means coupled to the screen means for attaching a gift object to the screen;

an elongate cover having a first end proximate the back bottom edge and a distal second end, the cover adapted to occupy alternately a first position covering the window; and a second position forming a stand adapted to hold the box erect with the window open for viewing the object, the stand having a first stand segment extending from adjacent the back bottom edge rearward to a first crease;

a second stand segment extending substantially upward from the first crease to a second crease disposed adjacent the back;

a third stand segment extending downwardly from the second crease to a third crease disposed adjacent the back below the second crease, the second and third stand segments thereby forming a transverse, upwardly projecting wedge;

a fourth stand segment extending from the third crease to a fourth crease disposed adjacent the first crease; and a fifth stand segment extending from the fourth crease to the second end disposed adjacent the first end.

2. The gift box according to claim 1 and further comprising securing means disposed on the back for securing the box cover to the back when it occupies its second position.

3. The gift box according to claim 2 wherein the securing means comprises at least one tab disposed on the back and adapted to receive the upwardly projecting wedge formed between the second and third stand segments.

4. The gift box according to claim 1 wherein when the cover occupies its first position the first and second stand segments are disposed adjacent the back;

the third stand segment is disposed atop the gift box with the second and third creases adjacent the back top edge and the front top edge respectively; and the fourth and fifth stand segments are disposed adjacent the front.

5. The gift box according to claim 1 wherein the screen means comprises a plurality of wings extending from the front toward the back within the interior; and a planar plate coupled to and spanning between at least two of the wings adjacent the back.

6. The gift box according to claim 1 wherein the attachment means comprises removable adhesive globules adhering to the gift object and the screen.

7. The gift box according to claim 1 and further comprising at least one graphic illustration disposed on a screen visible within the window; and at least one graphic message disposed on the front face of the body, wherein the graphic illustration and the graphic message are related to the gift object.

8. A greeting card adapted to display an object, the greeting card comprising a body having a substantially planar front, a back disposed a spaced distance behind the front and having a top edge, and at least one side wall coupled between the front and back to define an interior;

a window disposed within the interior and open to the front, the object visible through the window;

screen means disposed within the window; and an elongate cover coupled by a proximate first cover end to the back and extending to a distal second cover end, the cover adapted alternately to occupy a first position forming a cover for the window; and a second position forming a stand adapted to hold the box at an erect viewing angle for viewing the object through the window, the stand being formed by extending the cover rearward from its first end substantially normal to the back;

folding the cover at a first crease a spaced distance rearward of the back to form a first stand segment;

folding the cover at a second crease to form a second stand segment disposed at an angle to the first stand segment;

folding the cover at a third crease to form a third stand segment disposed adjacent and at an angle to the second stand segment, thereby forming a transverse, upwardly projecting wedge adapted to be secured to the back by securing means; and folding the cover at a fourth crease to cause the second end to be disposed adjacent the first end.

9. The greeting card according to claim 8 wherein the screen means comprises a plurality of wings extending from the front toward the back within the interior; and a planar plate coupled to and spanning between at least two of the wings adjacent the back.

10. The greeting card according to claim 8 and further comprising coupling means for coupling an object to the screen means for viewing the object through the window when the cover is removed.

11. The greeting card according to claim 10 wherein the coupling means comprises removably adhesive globules.

12. The greeting card according to claim 8 wherein the securing means comprises a plurality of horizontal tabs disposed on the back, each tab adapted to receive the upwardly projecting wedge formed between the second and third stand segments, whereby the upwardly projecting wedge may be moved from within one of the tabs to within another tab to change the viewing angle.

13. The greeting card according to claim 8 and further comprising at least one graphic illustration disposed on the screen means and visible through the window; and at least one graphic message disposed on the front face of the body, wherein the graphic illustration and the graphic message are related to the gift object.

14. The greeting card according to claim 8 wherein, when the cover is in its first position, the first and second stand segments are disposed parallel to and adjacent the back and extend from the first cover end to the top edge of the back, the third stand segment spans between the back top edge and the front; and the fourth and fifth stand segments are disposed across and affixed to the front whereby the greeting card forms a protective enclosure for the gift object.

15. The greeting card according to claim 8 wherein the second and third creases are spaced apart a distance substantially equal to the spaced distance between the front and the back; and the second crease is disposed adjacent the back top edge, whereby, when the cover is in its first position, the greeting card forms a box for transporting the gift object.

16. An improved method of displaying an object, the method comprising providing a display box having a body having a substantially planar front, a back disposed a spaced distance behind the front, and at least one side wall coupled between the front and back to define an interior;

a window disposed within the interior and open to the front and adapted to receive and display the object;

an elongate shroud coupled by its first end to the back and extending to a distal second end disposed adjacent the front and adapted to be removably secured to the front to cover the window; and securing means disposed on the back a spaced distance from the at least one side wall for securing a portion of the shroud to the back;

providing the object selected to be displayed and affixing it within the window; then disengaging the second end from covering the window and folding the cover backward to uncover the window and to form a stand by extending the cover rearward from its first end substantially normal to the back;

folding the cover at a first crease a spaced distance rearward of the back to form a first stand segment;

folding the cover at a second crease to form a second stand segment disposed at an acute angle to the first stand segment;

folding the cover at a third crease to form a third stand segment disposed adjacent and at an acute angle to the second stand segment, thereby forming a transverse, upwardly projecting wedge;

folding the cover at a fourth crease to cause the second end to be disposed adjacent the first end; then engaging the wedge with the securing means; then placing the gift box on a surface so that it rests upon the first segment whereby the front is disposed in a substantially vertical direction relative to the surface with the window open and the object visible within the window.

17. The improved method of claim 16 wherein the object may be stored in the display box by executing the additional steps of disengaging the wedge from the securing means; then straightening the shroud by unfolding the creases; then flexing the shroud at its first end to cause the first and second segments to lie juxtaposed to the back;

folding the shroud at the second crease to cause the third segment to lie juxtaposed a portion of the at least one side wall;

folding the shroud at the third crease to cause the fourth segment and the second end to lie juxtaposed the planar front and covering the window; then engaging the second end to close the display box and cover the window; then storing the display box resting in any position.

18. The improved method according to claim 16 wherein the securing means comprises at least one tab disposed on the back and adapted to receive a wedge formed between two adjacent linear segments.

19. A gift box adapted to display a gift object, the gift box comprising a body having a front, a back disposed a spaced distance behind the front, and at least one side wall coupled between the front and back to define an interior;

a window having a perimeter and disposed within the interior, the window being open to the front and adapted to receive and display the object;

an elongate shroud coupled by its first end to the back and extending to a distal second end, the shroud adapted alternately to occupy a first position forming a cover for the window; and a second position forming a stand adapted to hold the box erect with the window open for viewing the object, the stand being formed by extending the shroud rearward from its first end substantially normal to the back;

folding the shroud at a first crease a spaced distance rearward of the back to form a first stand segment;

folding the shroud at a second crease to form a second stand segment disposed at an angle to the first stand segment;

folding the shroud at a third crease to form a third stand segment disposed adjacent and at an angle to the second stand segment, thereby forming a transverse, upwardly projecting wedge adapted to be secured to the back by securing means; and folding the shroud at a fourth crease to cause the second end to be disposed adjacent the first end.

20. The greeting card according to claim 19 and further comprising a screen disposed within and coextensive with the window, the screen having a rear plate coaxial with the window and disposed adjacent the back within the interior, the rear plate having screen edges; and wings extending from the screen edges to couple to the perimeter of the window to seal off the window from the interior;

coupling means disposed on the rear plate for coupling the object to the screen;

at least one graphic illustration disposed on the screen and visible through the window; and on the front of the body, wherein the graphic illustration and the graphic message are related to the gift object.

* * * * *